US008636275B2

(12) United States Patent
Kambayashi et al.

(10) Patent No.: US 8,636,275 B2
(45) Date of Patent: Jan. 28, 2014

(54) AUTOMATIC DOCUMENT FEEDER AND IMAGE FORMING APPARATUS INCLUDING THE SAME

(75) Inventors: Mamoru Kambayashi, Tokyo (JP); Motoya Sano, Kanagawa (JP); Hideki Tobinaga, Tokyo (JP); Shinya Kitaoka, Kanagawa (JP); Atsushi Kanaya, Kanagawa (JP); Norio Kimura, Kanagawa (JP); Michitaka Suzuki, Kanagawa (JP); Yoshito Suzuki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/067,381

(22) Filed: May 27, 2011

(65) Prior Publication Data

US 2011/0304092 A1 Dec. 15, 2011

(30) Foreign Application Priority Data

Jun. 15, 2010 (JP) ..... 2010-136331

(51) Int. Cl.
*B65H 83/00* (2006.01)

(52) U.S. Cl.
USPC ..... 271/3.17; 271/117; 271/121

(58) Field of Classification Search
USPC ..... 271/114, 117, 118, 3.17, 4.05, 4.07, 271/124, 125, 265.01, 121, 258.01
See application file for complete search history.

(56) References Cited

U.S. PATENT DOCUMENTS

| | | | | |
|---|---|---|---|---|
| 6,788,440 | B1 * | 9/2004 | Sashida | 358/498 |
| 7,922,169 | B2 * | 4/2011 | Mandel | 271/121 |
| 2007/0085262 | A1 * | 4/2007 | Mitsuya et al. | 271/121 |
| 2010/0148423 | A1 * | 6/2010 | Morita et al. | 271/10.03 |

FOREIGN PATENT DOCUMENTS

| | | | |
|---|---|---|---|
| JP | 10095552 | A | 4/1998 |
| JP | 3792468 | | 8/2001 |
| JP | 2004352402 | A | 12/2004 |
| JP | 2005263396 | A | 9/2005 |

OTHER PUBLICATIONS

Abstract of JP 2001-233477 published Aug. 28, 2001.

* cited by examiner

*Primary Examiner* — Thomas Morrison
(74) *Attorney, Agent, or Firm* — Harness, Dickey & Pierce P.L.C.

(57) ABSTRACT

An automatic document feeder includes a separating and feeding unit which has a separating member and a paper feeding member coming into contact with the separating member at a predetermined separating pressure, and separates and feeds an original sheet by sheet from a bundle of originals placed on an original placing table; a conveying unit which conveys the original separated by the separating and feeding unit toward a scanning position; a separating pressure switching unit which applies and releases the separating pressure and which is controlled by a control unit to release the separating pressure after a leading edge of a preceding sheet of the original has passed through the separating and feeding unit and to apply the separating pressure before a sheet of original separated and fed next to the preceding sheet of original is fed from the bundle of original to the separating and feeding unit.

11 Claims, 15 Drawing Sheets

AUTOMATIC DOCUMENT FEEDER AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2010-136331 filed in Japan on Jun. 15, 2010.

BACKGROUND OF THE INVENTION

1. Field of the Invention

The present invention relates to an automatic document feeder (ADF) and an image forming apparatus, for example, to an automatic document feeder which automatically feeds an original sheet by sheet from a bundle of originals placed on an original tray and an image forming apparatus including the automatic document feeder, such as a facsimile machine, a copying machine, or a multi-function peripheral (MFP).

2. Description of the Related Art

In general, in an image forming apparatus including an automatic document feeder, as a scanning method of scanning an image of an original, there are methods including a so-called book type scanning method in which an original on a glass platform is scanned while a traveling member is driven to move a scanning position and a so-called sheet-through type scanning method in which an image scanning unit is fixed and an original as a scanning target is fed at a constant rate.

In the sheet-through type scanning method, the original is automatically fed to the scanning position from a bundle of originals set in the automatic document feeder, and scanning is carried out. For this reason, the sheet-through type scanning method is more advantageous in increasing a productivity in scanning an original than the book type scanning method. In recent years, there is an attempt to increase a scanning rate of the original in seeking for further improvement in the productivity by using the sheet-through type scanning method.

In the related art, as an automatic document feeder which realizes a sheet-through type scanning method, it is known that there is a type of an automatic document feeder which includes a separating section on a downstream side of a paper feeding port. The separating section includes a conveying roller and a separator which is pressed against the conveying roller by a resilient member, and when an original being made of a plurality of sheets is fed from the paper feeding port, the original is separated sheet by sheet by frictional resistance generated between the conveying roller and the separator in the separating section to convey to the scanning position on the downstream side of the separating section (for example, see Japanese Patent Application Laid-open No. H10-095552).

In the automatic document feeder described in Japanese Patent Application Laid-open No. H10-095552, in scanning an original, such as a photograph original that requires high resolution, an engaging member serving as an operating portion is made to slide to forcibly separate the separator from the conveying roller so that a gap is formed between the conveying roller and the separator. Thus, in scanning an original which requires high resolution, it is possible to convey the original at a uniform conveying rate without applying a load to the original which passes through the separating section.

Incidentally, in the sheet-through type scanning method, it is necessary to scan an image with no bending, which is often called to be skewed. Hence, in the automatic document feeder, it is necessary to convey an original to a scanning position without being skewed.

As the automatic document feeder of the related art, for example, there is an automatic document feeder which is known to have a function to separate an original, when two sheets of the original are fed from a bundle of original that has been set in a paper feeding port as being overlapped (which is referred to as a double feeding hereafter), the double-fed original is separated into two sheets by a paper feeding belt and a reverse roller. In this automatic document feeder, during the above-described original separating operation, force in the conveying direction exerted to a first sheet of the original by the paper feeding belt conflicts with force in the direction opposite to the conveying direction exerted to a second sheet of the original by the reverse roller, so that the conveying process of the original is likely to go out of balance to cause a skew in the original. A direction of the conveying force of a conveying unit such as the conveying roller may deviate from a principal direction of scanning due to a variation in production accuracy of components included in the automatic document feeder. Therefore, there is a possibility that a skew may occur due to the variation of the direction in the conveying force from a principal direction of scanning even for an original which has passed through the separating section that includes the paper feeding belt and the reverse roller which are equipped to avoid an occurrence of the double feeding.

In recent years, an automatic document feeder is proposed in which a skew of an original is corrected so that an image without a skew is scanned. In this type of automatic document feeder, an abutting roller or the like for a skew correction is provided on the upstream side of the scanning position, and an original abuts on the abutting roller so as to correct a skew.

However, even when a skew correction has been carried out, if a variation occurs in the conveying force by the conveying unit in a conveying process that follow, the original after skew correction begins to be folded, and a skew may occur again before the original reaches the scanning position.

In the automatic document feeder of the related art, as an origin for an occurrence of a skew in the original, in addition to a deviation in the direction of the conveying force from the principal scanning direction of the conveying unit, it is exemplified that the separating section becomes a conveying resistance against the conveying force by the conveying unit.

In particular, on a so-called edge face basis in which one side surface of the original is fixed, depending on a size of the original, the conveying resistance in the separating section may become asymmetric with respect to a center of the original. This may cause an imbalance in the conveying force to trigger the occurrence of a skew. On the contrary, even on the so-called center basis in which movable side guides arranged on both sides to be symmetric with respect to the conveying center, in a plurality of pressing rollers or the like arranged in the width direction of the original, for example, if a variation occurs in the pressing balance in each component, similarly to the edge face basis, a skew may occur to the original, too. In the center basis, when side fences are not appropriately set in setting the original, such as a case where the side fences are set asymmetrically or a case where the side fences are set at positions so that gaps open between the originals and the side fences, the original is asymmetrically balanced with respect to the separating section, and similarly to the above, a skew of the original may occur.

In order to stably convey the original, the conveying force of the conveying roller on the downstream side of the separating section is generally set to a value so as to overcome the conveying resistance in the separating section. In this case, it is necessary to set the pressing force of the conveying roller on the downstream side of the separating section to be large and, hence, it is necessary to increase rigidity of members around the conveying roller.

In the meantime, in order to reduce the conveying resistance in the separating section, for example, as in the automatic document feeder described in Japanese Patent Application Laid-open No. H10-095552, it is considered that the separator is forcibly separated from the conveying roller to reduce the conveying resistance in the separating section.

In this case, as described above, in order to improve the productivity in scanning an original, it is necessary to shorten an interval between the sheets of the original to be conveyed, and thus it is necessary to carry out the separating operation in the separating section at a short interval. Thus, after the separating pressure in the separating section is released so as to reduce the conveying resistance, it is necessary to apply the separating pressure as soon as the next sheet of the original is ready to be fed.

However, in the automatic document feeder described in Japanese Patent Application Laid-open No. H10-095552, a separating section is designed such that separating pressure serving as conveying resistance in the separating section is simply released by a manual operation depending on the types of originals, and the separating pressure is not released and applied automatically while the original is being conveyed, for example. Thus, in the automatic document feeder described in Japanese Patent Application Laid-open No. H10-095552, no consideration is given to an application of the separating pressure after the separating pressure is released, so that no clue has been provided to suppress the occurrence of a skew in an original as well as to improve the productivity in canning the original.

SUMMARY OF THE INVENTION

It is an object of the present invention to at least partially solve the problems in the conventional technology.

According to an aspect of the present invention, there is provided an automatic document feeder including: a separating and feeding unit which has a separating member and a paper feeding member coming into contact with the separating member at a predetermined separating pressure, and separates and feeds an original sheet by sheet from a bundle of originals placed on an original placing table by cooperation of the separating member and the paper feeding member; a conveying unit which conveys the original separated by the separating and feeding unit toward a scanning position; a separating pressure switching unit which applies and releases the separating pressure; and a control unit which controls the separating pressure switching unit to release the separating pressure after a leading edge of a preceding sheet of the original has passed through the separating and feeding unit and to apply the separating pressure before a sheet of original separated and fed next to the preceding sheet of original is fed from the bundle of original to the separating and feeding unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of the invention will be described with reference to the drawings.

Figure 1:
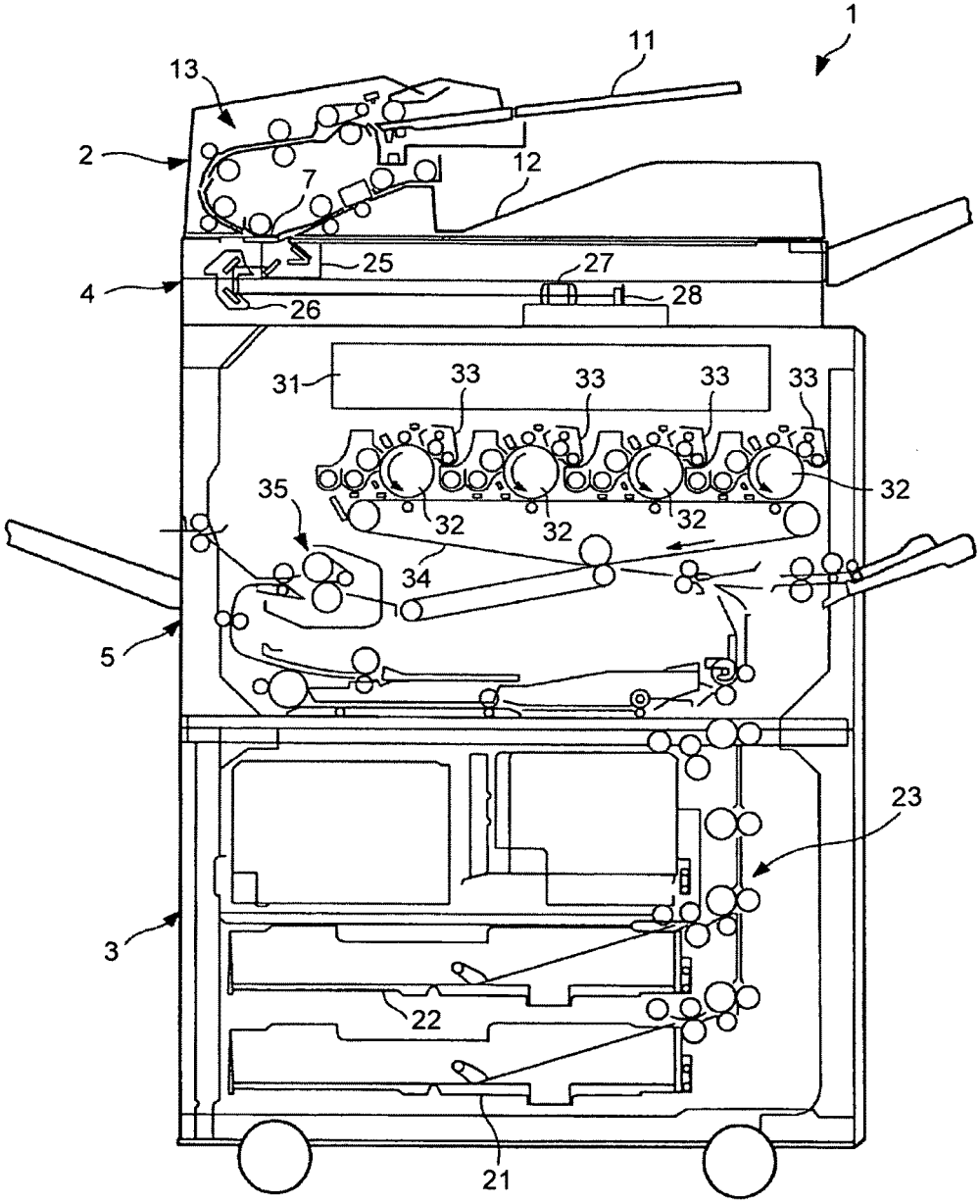
FIG. 1 is a schematic configuration diagram of an image forming apparatus including an ADF according to an embodiment of the invention.

FIG. 1 is a diagram showing an embodiment of an image forming apparatus including an automatic document feeder according to the invention. In this embodiment, an image forming apparatus is applied to a copying machine 1.

As shown in FIG. 1, the copying machine 1 includes an automatic document feeder (hereinafter, referred to as an ADF) 2, a paper feeding unit 3, an image scanning unit 4, and an image forming unit 5.

The ADF 2 includes an original tray 11 which serves as an original placing table, and a conveying unit 13 which has various rollers and the like. The ADF 2 is configured in such a manner that the conveying unit 13 conveys an original placed on the original tray 11 onto a slit glass 7, and the original which has been scanned by the image scanning unit 4 through the slit glass 7 passes over the slit glass 7 and is discharged to a discharge tray 12. The ADF 2 is attached to the image scanning unit 4 in an openable manner through an opening/closing mechanism (not shown).

The paper feeding unit 3 has sheet cassettes 21 and 22 which store recording sheets having different sizes, and a paper feeding unit 23 which includes various rollers to convey the recording sheets having been stored in the sheet cassettes 21 or 22 to an image forming position of the image forming unit 5.

The image scanning unit 4 includes a first carriage 25 on which a light source and a mirror member are mounted, a second carriage 26 on which a mirror member is mounted, an imaging lens 27, and an image capturing unit 28. The image scanning unit 4 is configured in such a manner that light is irradiated from the light source mounted on the first carriage 25 onto the original passing over the slit glass 7, and that a direction of a reflected light from the original is reversed by being reflected by the mirror members mounted on the first carriage 25 and the second carriage 26, and an image is formed with the reflected light by using the imaging lens 27 and to be read by the image capturing unit 28.

The image forming unit 5 includes an exposing unit 31, a photosensitive element 32, a developing unit 33, a transfer belt 34, and a fixing unit 35. The image forming unit 5 is configured in such a manner that the exposing unit 31 exposes the photosensitive element 32 on the basis of the image read by the image capturing unit 28 to form a latent image on the photosensitive element 32, and the developing unit 33 supplies toner of different colors to the photosensitive element 32 to develop the latent image. The image forming unit 5 is configured in such a manner that the transfer belt 34 transfers the image developed on the photosensitive element 32 to a recording sheet fed from the paper feeding unit 3, and the fixing unit 35 melts toner of a toner image transferred to the recording sheet to fix a color image to the recording sheet.

Next, the ADF 2 is described in detail with reference to FIG. 2.

Figure 2:
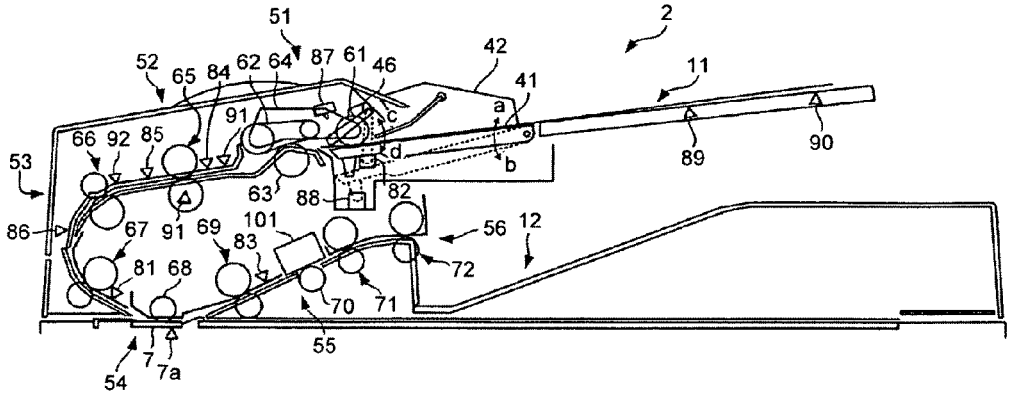
FIG. 2 is a schematic sectional view of the ADF according to the embodiment of the invention.

As shown in FIG. 2, the original tray 11 has a movable original table 41 and a pair of side guide plates 42. The movable original table 41 nearly forms a first half portion, or a front half in a paper feeding direction, of the original tray 11 and is made to turn in directions denoted by a and b in the drawing with a base portion as a fulcrum. Thus, the original tray 11, on which the original is placed, is made such that a height of the front portion of the original in the paper feeding direction can be adjusted appropriately by turning the movable original table 41.

A table elevation sensor 87 is provided above a leading edge portion of the movable original table 41. The table elevation sensor 87 detects whether or not the front portion in the paper feeding direction of the original placed on the original placing surface is maintained at an appropriate feeding position to keep an appropriate height.

A home position sensor 88 is provided below the leading edge portion of the movable original table 41. The home position sensor 88 detects that the movable original table 41 is at a home position.

In a second half portion, or a rear half portion in the paper feeding direction, of the original tray 11, document-length detection sensors 89 and 90 which detect whether a sheet of the original is set in a direction of a portrait image format or in a direction of a landscape image format are provided by being separated from each other in the paper feeding direction. As the original-length detection sensors 89 and 90, a reflective sensor which carries out detection by an optical unit in a non-contact manner, or a contact sensor of an actuator type may be used.

The pair of side guide plates 42 is provided upright so as to position edges in left-right directions with respect to the paper feeding direction of the original placed on the original tray 11. One of the pair of side guide plates 42 freely slides in the left-right directions with respect to the paper feeding direction, so that originals of different sizes can be placed on the original tray 11.

On the fixed side of the pair of side guide plates 42, a set filler 46 is provided to turn when an original is placed. At a lowermost position in a track of a motion of a front portion of the set filler 46, an original-setting sensor 82 is provided to detect that an original is placed on the original tray 11. That is, if the original is placed on the original tray 11, the set filler 46 turns and the front portion of the set filler 46 is removed from the original-setting sensor 82, so that the original-setting sensor 82 detects the presence/absence of an original that may be set in the ADF 2.

The conveying unit 13 (see FIG. 1) of the ADF 2 includes a separating and feeding unit 51, a pullout unit 52, a turning unit 53, a first scanning-conveying unit 54, a second scanning-conveying unit 55, and a sheet discharging unit 56.

The separating and feeding unit 51 has a pickup roller 61 arranged in the vicinity of a paper feeding port, and a paper feeding belt 62 and a reverse roller 63 arranged to face each other across a conveying path therebetween. In this embodiment, the paper feeding belt 62 and the reverse roller 63 constitute a separating-feeding unit according to the invention. The paper feeding belt 62 constitutes a paper feeding member according to the invention, and the reverse roller 63 constitutes a separating member according to the invention.

The pickup roller 61 is supported by a supporting arm member 64 attached to the paper feeding belt 62, and moves up and down in the c and d directions of the drawing between a contact position where the pickup roller 61 comes into contact with the bundle of originals through a cam mechanism (not shown) and a separate position where the pickup roller 61 is separated from the bundle of originals. The pickup roller 61 picks up several sheets (ideally, one sheet) of the original from among the sheets of the original placed on the original tray 11 at the contact position.

The paper feeding belt 62 circulates in the paper feeding direction, and the reverse roller 63 rotates in the direction opposite to the paper feeding direction. Although the reverse roller 63 rotates in the opposite direction to the paper feeding belt 62 when the original is double-fed, the reverse roller 63 rotates in association with the paper feeding belt 62 by the action of a torque limiter (not shown) when the reverse roller 63 is in contact with the paper feeding belt 62 or when only one sheet of the original is conveyed. Thus, double feeding of the original is prevented. The paper feeding belt 62 is configured to be able to turn up and down between a contact position where the paper feeding belt 62 is in contact with the reverse roller 63 and a separate position where the paper feeding belt 62 is separated from the reverse roller 63.

The details of the separating and feeding unit 51 in which the paper feeding belt 62 is configured to be rotatable will be described later.

The pullout unit 52 has a pullout roller 65 which includes a pair of rollers that are arranged to sandwich the conveying path therebetween. The pullout unit 52 carries out primary abutting matching (so-called a skew correction) at a driving timing of the pullout roller 65 and the pickup roller 61, and extracts and conveys the original after matching. The pullout roller 65 conveys the original after being separated toward a scanning position 7*a*. In this embodiment, the pullout roller 65 constitutes a conveying unit according to the invention.

The turning unit 53 has a curved conveying path which is curved downward from above along the conveying path. The turning unit 53 has an intermediate roller 66 and a scanning entrance roller 67, each of which consist of a pair of rollers arranged so as to sandwich the curved conveying path therebetween. The turning unit 53 turns the original that is extracted and conveyed by the intermediate roller 66 along the curved conveying path and conveys the original by the scanning entrance roller 67 to a position near the slit glass 7 (the scanning position 7*a*) at which the front surface of the original is turned downward.

The original-conveying rate from the pullout unit 52 to the turning unit 53 is set to be higher than the original-conveying rate in the first scanning-conveying unit 54. Thus, a reduction in a conveying time of the original conveyed in the first scanning-conveying unit 54 is achieved.

The first scanning-conveying unit 54 has a first scanning roller 68 which is arranged at a position facing the slit glass 7 with the conveying path sandwiched therebetween, and a first scanning exit roller 69 which consists of a pair of rollers arranged so as to sandwich the conveying path therebetween after finishing scanning. The first scanning-conveying unit 54 conveys the original, which has been conveyed to a position near the slit glass 7, with the use of the first scanning roller 68 to keep the front surface of the original being in contact with the slit glass 7, and further conveys the original after finishing scanning by the first scanning exit roller 69.

The second scanning-conveying unit 55 has a second scanning roller 70 which is arranged at a position facing a second scanning unit 101, which scans the rear surface of the original, with the conveying path sandwiched therebetween, and a pair of second scanning exit rollers 71 which are arranged on the downstream side of the second scanning unit 101. In the second scanning-conveying unit 55, the rear surface of the original with the front surface thereof scanned is scanned by the second scanning unit 101. The original after the rear surface thereof is scanned is conveyed toward a sheet discharge port by the second scanning exit roller 71. The second scanning roller 70 suppresses floating of the original in the second scanning unit 101 and also serves as a white reference unit which obtains shading data in the second scanning unit 101.

When duplex scanning is not carried out, the original passes the second scanning unit 101 without being scanned.

The sheet discharging unit 56 is provided with a pair of sheet discharging rollers 72 in the vicinity of the sheet discharge port, and discharges the original conveyed by the second scanning exit roller 71 to the discharge tray 12.

The ADF 2 is also provided with an abutting sensor 84, a scanning entrance sensor 86, a registration sensor 81, and a discharging sensor 83 along the conveying path, and these sensors are used to control conveying by controlling a conveying distance of the original, the original-conveying rate, and the like. In this embodiment, the abutting sensor 84 constitutes a first detection unit according to the invention.

In the ADF 2, a separation sensor 91 is provided in the conveying path between the separating and feeding unit 51 and the pullout unit 52. The separation sensor 91 detects a leading edge and a trailing edge of the original that is conveyed to the pullout unit 52 after being separated by the separating and feeding unit 51. In this embodiment, the leading edge of the original means leading edge in the paper feeding direction and the leading edge in the conveying direction of the original, and the trailing edge of the original means the trailing edge in the paper feeding direction and the trailing edge in the conveying direction trailing edge of the original. In this embodiment, the separation sensor 91 constitutes a second detection unit according to the invention.

An original-width sensor 85 and a separation starting sensor 92 are provided in the conveying path between the pullout roller 65 and the intermediate roller 66, that is, on the downstream side of the pullout roller 65 in the original-conveying direction. The original-width sensor 85 consists of a plurality of light-receiving elements arranged in the width direction of the original, and detects the original width on the basis of the light-receiving results from irradiated light provided at opposing positions with the conveying path sandwiched therebetween. The separation starting sensor 92 detects the leading edge of the original after passing through the pullout roller 65. In this embodiment, the separation starting sensor 92 constitutes a third detection unit according to the invention.

Next, the control configuration of the ADF 2 will be described with reference to FIG. 3.

Figure 3:
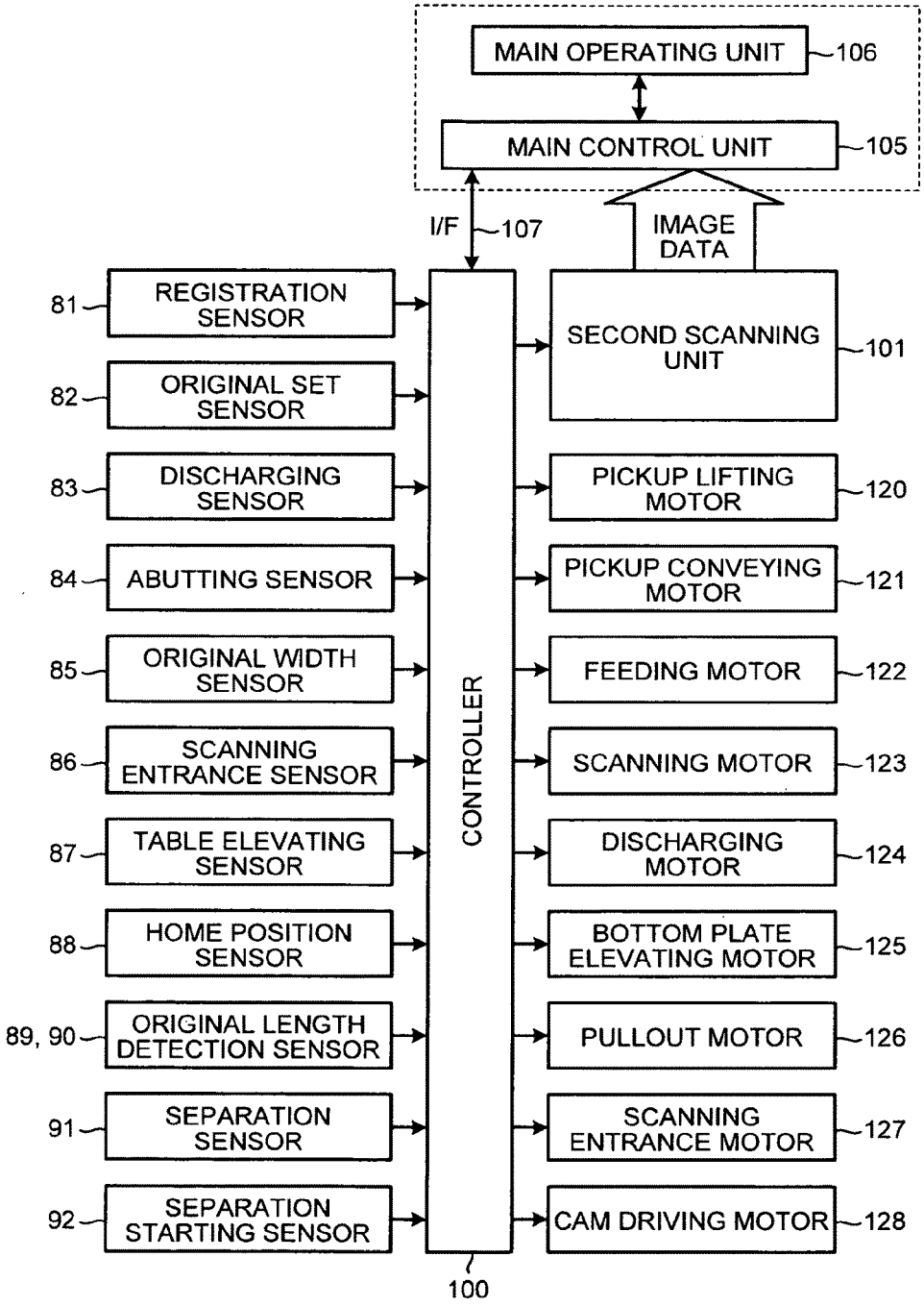
FIG. 3 is a block diagram showing the control configuration of the ADF according to the embodiment of the invention.

As shown in FIG. 3, the ADF 2 includes a controller 100 which performs overall control of the ADF 2. In this embodiment, the controller 100 performs a separating pressure switching control to be described below. In this embodiment, the controller 100 constitutes a control unit according to the invention.

As sensors and the like which input signals to the controller 100, the ADF 2 includes the registration sensor 81, the original-setting sensor 82, the discharging sensor 83, the abutting sensor 84, the original-width sensor 85, the scanning entrance sensor 86, the table elevation sensor 87, the home position sensor 88, the original-length detection sensors 89 and 90, the separation sensor 91, and the separation starting sensor 92.

The sensors are connected to the controller 100 and transmit signals showing detection results to the controller 100.

As motors and the like which control to drive respective units of the ADF 2 on the basis of signals output from the controller 100, the ADF 2 includes a pickup lifting motor 120, a pickup conveying motor 121, a feeding motor 122, a scanning motor 123, a discharging motor 124, a bottom plate elevating motor 125, a pullout motor 126, a scanning entrance motor 127, and a cam driving motor 128. These motors are connected to the controller 100.

The bottom plate elevating motor 125 moves up and down the movable original table 41, and the pickup lifting motor 120 moves up and down the pickup roller 61.

The pickup conveying motor 121 drives to rotate the pickup roller 61. The feeding motor 122 drives to circulate the paper feeding belt 62 and the reverse roller 63. In this embodiment, the feeding motor 122 constitutes a driving unit according to the invention.

The pullout motor 126 drives to rotate the pullout roller 65. As described above, in this embodiment, the pullout roller 65 can be rotated by the pullout motor 126 independently from other motors to make it possible to reduce the ramp-up time and ramp-down time of the motor and to contribute to the improvement of the productivity in scanning the original.

The scanning entrance motor 127 drives to rotate the scanning entrance roller 67. The scanning motor 123 drives to rotate the first scanning roller 68, the first scanning exit roller 69, and the second scanning exit roller 71. The discharging motor 124 drives to rotate the sheet discharging rollers 72.

The cam driving motor 128 drives to rotate a cam member 145 to be described below.

The motors are controlled by the controller 100 on the basis of the detection signals of the sensors. The ADF 2 is provided with the second scanning unit 101 which scans the rear surface of the original, and the second scanning unit 101 is connected to the controller 100.

The copying machine 1 includes a main control unit 105 which carries out overall control of the machine, and a main operating unit 106 which carries out various input operations or operation instructions. The controller 100 and the main control unit 105 are connected to each other through an interface (I/F) unit 107, and exchange data, such as control signals, with each other. The main operating unit 106 is configured such that a user can select a mode in scanning an original in the ADF 2 between a duplex scanning mode and a single scanning mode. The user may set the same scanning mode for the entire original placed on the original tray 11 or may set different scanning modes for the different sheets of the original. For example, the duplex scanning mode may be set for a first sheet and a tenth sheet of the original from among a bundle of originals having ten sheets of the original, and the single scanning mode may be set for other sheets of the original.

In the ADF 2 configured as above, if the leading edge of the original which passes through the separating and feeding unit 51, the pullout unit 52, and the turning unit 53 and is conveyed to the first scanning-conveying unit 54 is detected by the scanning entrance sensor 86, the original-conveying rate is decelerated so that the original-conveying rate may be set to be equal to the scanning-conveying rate before the leading edge of the original enters the nip portion of the scanning entrance roller 67. At the same time, the scanning entrance motor 127 and the scanning motor 123 are driven forward (CW) so as to rotate the scanning entrance roller 67, the first scanning roller 68, the first scanning exit roller 69, and the second scanning exit roller 71.

If the leading edge of the original is detected by the registration sensor 81, the conveying rate of the original is decelerated within a predetermined conveying distance and the original is temporarily stopped near the scanning position 7*a*. Then, the controller 100 transmits a registration stop signal to the main control unit 105 through the I/F 107. Subsequently, if a scanning start signal is received from the main control unit 105, the conveying rate of the original which has been stopped of the registration is increased so as to reach a predetermined original-conveying rate and the original is conveyed until the leading edge of the original reaches the scanning position 7*a*. At the timing when the leading edge of the original detected by counting pulses of the scanning entrance motor 127 reaches the first scanning-conveying unit 54, a gate signal denoting an effective image region of a first surface (front surface) in a sub-scanning direction is transmitted to the main control unit 105 until the trailing edge of the original goes out of the first scanning-conveying unit 54.

When the scanning mode is the single scanning mode, the original having passed through the first scanning-conveying unit 54 passes through the second scanning unit 101 and is conveyed to the sheet discharging unit 56. At this time, if the leading edge of the original is detected by the discharging sensor 83, the discharging motor 124 is driven forward (CW) to rotate the sheet discharging rollers 72 in a counterclockwise direction. At this time, through counting pulses of a discharging motor after the leading edge of the original is detected by the discharging sensor 83, the driving speed of the discharging motor 124 is decelerated immediately before the trailing edge of the original goes out of the nip of a pair of upper and lower rollers of the sheet discharging rollers 72 so that the original discharged onto the discharge tray 12 is not scattered.

When the scanning mode is the duplex scanning mode, at the timing when the leading edge of the original reaches the second scanning unit 101 by counting pulses of the scanning motor 123 after the leading edge of the original is detected by the discharging sensor 83, the gate signal which represents the effective image region in the sub-scanning direction is transmitted from the controller 100 to the second scanning unit 101 until the trailing edge of the original goes out of the second scanning unit 101.

Next, the control configuration of the second scanning unit 101 is described with reference to FIG. 4.

Figure 4:
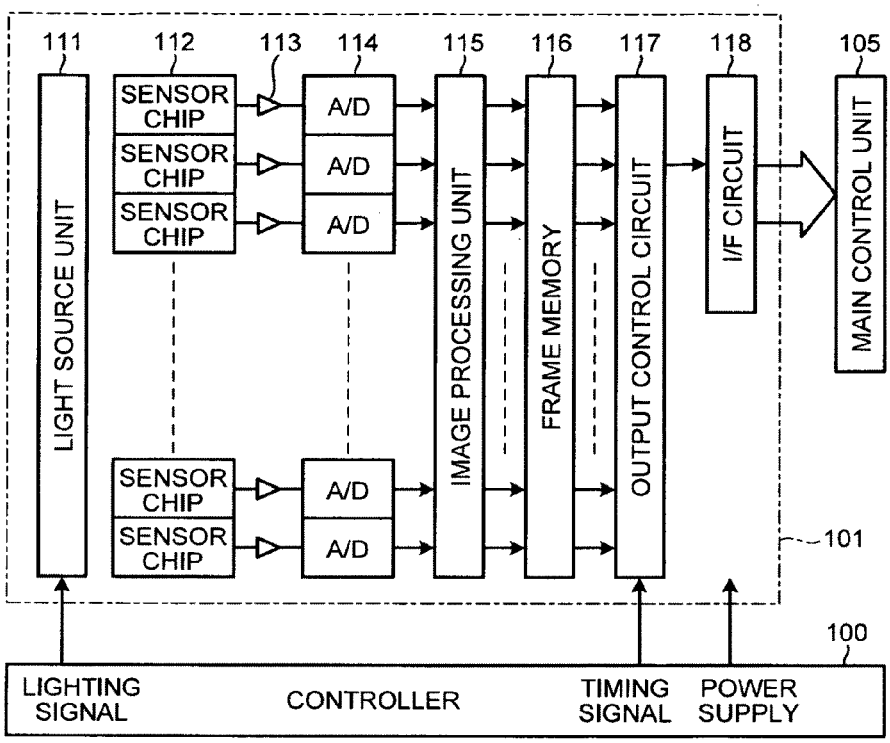
FIG. 4 is a block diagram showing the control configuration of a second scanning unit in the ADF according to the embodiment of the invention.

As shown in FIG. 4, the second scanning unit 101 includes a light source unit 111, sensor chips 112, an amplifier 113, an analogue-to-digital (A/D) converter 114, an image processing unit 115, and a frame memory 116.

The second scanning unit 101 is configured in such a way that the light source unit 111 irradiates light onto an original on the basis of a lighting signal from the controller 100, each sensor chip 112 receives reflected light from the original, and convert received light into an electrical signal to output. The second scanning unit 101 is configured in such a way that the amplifier 113 amplifies the electrical signal output from each sensor chip 112, the A/D 114 converts an analog signal to a digital signal on which image processing is carried out by the image processing unit 115, and the signal subjected to image processing is stored in the frame memory 116.

The second scanning unit 101 includes an output control circuit 117 which performs output control of the signals stored in the frame memory 116 on the basis of a timing signal from the controller 100, and an I/F circuit 118 which outputs a signal output from the output control circuit 117 to the main control unit 105.

Next, the balance of the conveying force in the separating and feeding unit 51 and the pullout unit 52 of the related art is described with reference to FIGS. 5 and 6.

Figure 5:
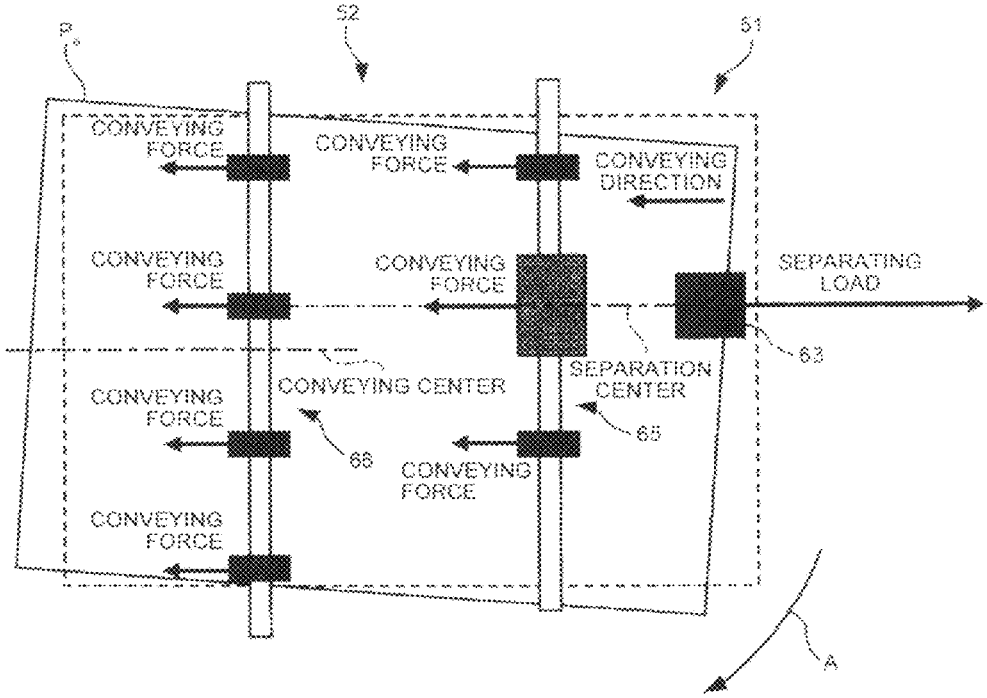
FIG. 5 is a diagram illustrating a skew in conveying an original on an edge face basis.

FIG. 5 is a diagram showing a skew of an original which occurs when an original $P_a$ having a comparatively large sheet width is separated and conveyed with the upper side of the drawing as an edge face basis. FIG. 6 is a diagram showing a skew of an original which occurs when an original $P_b$ with a sheet width smaller than the sheet width of the original $P_a$ is separated and conveyed.

As shown in FIG. 5, the original $P_a$ separated by the separating and feeding unit 51 is conveyed by the pullout roller 65 and the intermediate roller 66 arranged on the downstream side of the separating and feeding unit 51. At this time, the trailing edge of the original $P_a$ is in a state of being sandwiched between the paper feeding belt 62 and the reverse roller 63 at a predetermined separating pressure. As a result, a separating load in the direction opposite to the conveying direction is applied to the trailing edge of the original $P_a$.

The paper feeding belt 62 and the reverse roller 63 are arranged nearer the edge face basis (the upper side of the drawing) than the conveying center of the intermediate roller 66. As a result, a separation center to which the separating load is applied is located nearer to the edge face basis (the upper side of the drawing) than the conveying center, and hence, a twisting force is applied to the original $P_a$ and a skew occurs to the original $P_a$ in a direction indicated by an arrow A in the drawing. That is, the edge face basis side (the upper side of the drawing) of the original $P_a$ is skewed in the direction to which the separating load is applied, and a side of the original $P_a$ that is distant from the edge face basis (the lower side of the drawing) is skewed in the conveying direction.

Figure 6:
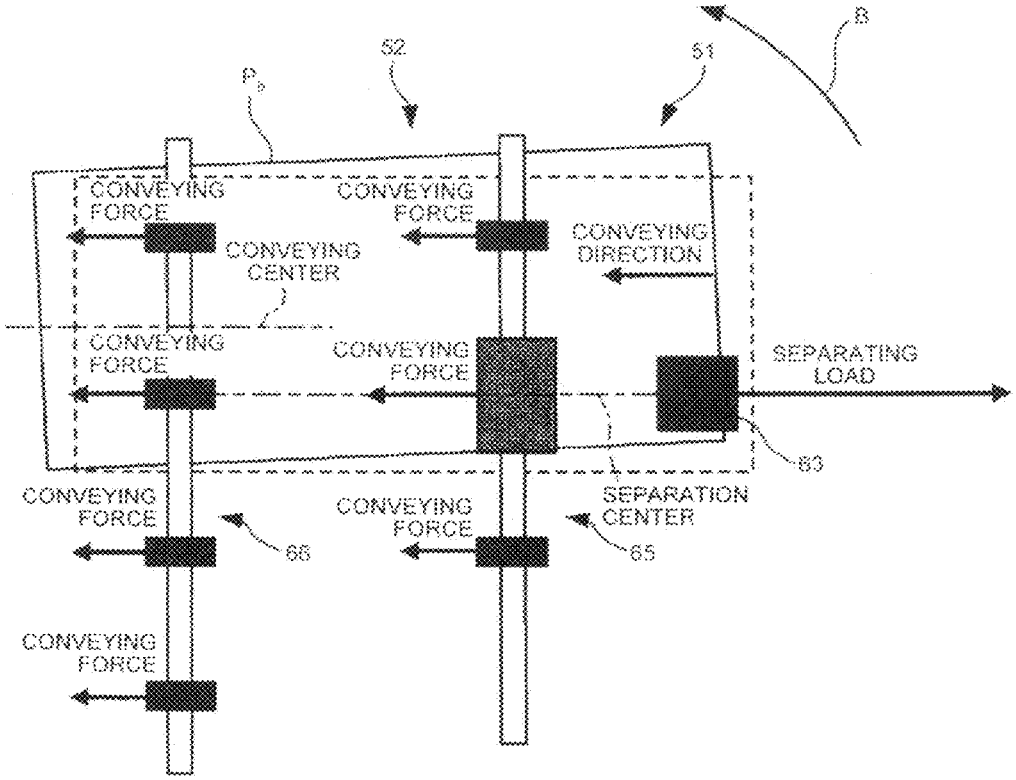
FIG. 6 is a diagram illustrating a skew in conveying an original on an edge face basis.

On the other hand, as shown in FIG. 6, as for the original $P_b$ having a small sheet width that is separated by the separating and feeding unit 51, the separation center to which the separating load is applied is located on the side separated from the edge face basis than the separation center (i.e., the lower side of the drawing), so that a twisting force in the opposite direction to the twisting force to the original $P_a$ in FIG. 5 is applied to the original $P_b$ and a skew occurs to the original $P_b$ in the direction indicated by an arrow B in the drawing. That is, the edge face basis side (the upper side of the drawing) of the original $P_b$ is skewed in the conveying direction, and a distant side of the original $P_b$ from the edge face basis (the lower side of the drawing) is skewed in the direction to which the separating load is applied.

As described above, in the related art, the separating load by the separating sheet feeding belt 62 and the reverse roller 63 is applied to the original $P_a$ and the original $P_b$ which are separated by the separating and feeding unit 51 and conveyed by the pullout roller 65 and the intermediate roller 66, and a skew occurs in both cases.

In this embodiment, in order to prevent a skew from occurring to an original due to the configuration of the separating load described above, a configuration is made in such a manner that the paper feeding belt 62 is separated from the reverse roller 63 at a predetermined timing. Hereinafter, a specific configuration will be described.

First, the details of the separating and feeding unit 51 are described with reference to FIGS. 7 and 8.

Figure 7:
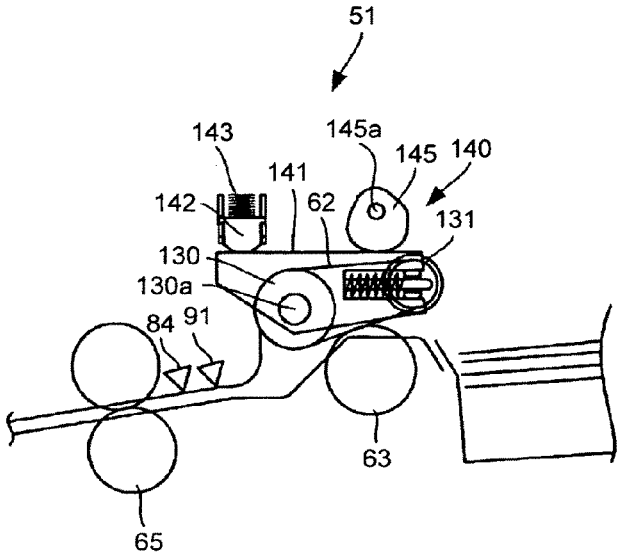
FIG. 7 is a diagram showing a separating and feeding unit in the ADF according to the embodiment of the invention and is a schematic configuration diagram showing a state where a paper feeding belt is at a contact position.

As shown in FIG. 7, the paper feeding belt 62 is looped over a paper feeding belt driving roller 130 and a paper feeding belt driven roller 131, and circulates by a rotation of the paper feeding belt driving roller 130. The paper feeding belt 62 is allowed to switch a position, by virtue of a separating pressure switching mechanism 140, between a contact position (position shown in FIG. 7) where the paper feeding belt 62 comes into contact with the reverse roller 63 at a predetermined separating pressure and a separate position (a position shown in FIG. 8) where the paper feeding belt 62 is separated from the reverse roller 63.

The separating pressure switching mechanism 140 includes a paper feeding belt holder 141, a pressing member 142, a biasing member 143, the cam member 145, and the cam driving motor 128. The separating pressure switching mechanism 140 brings the paper feeding belt 62 into contact with the reverse roller 63 to apply the separating pressure and separates the paper feeding belt 62 from the reverse roller 63 to release the separating pressure. In this embodiment, the separating pressure switching mechanism 140 constitutes a separating pressure switching unit according to the invention.

The paper feeding belt holder 141 rotatably supports the paper feeding belt driving roller 130 and the paper feeding belt driven roller 131, and is configured to pivot around a driving shaft 130*a* of the paper feeding belt driving roller 130. Specifically, the paper feeding belt is allowed to pivot on the driving shaft 130*a* to move a side of the paper feeding belt driven roller 131 in an upward direction or in a downward direction.

The pressing member 142 is biased downward by the biasing member 143 in the drawing to press one edge portion (an edge portion opposite to an edge portion of the paper feeding belt driven roller 131 side) of the paper feeding belt holder 141 so that the paper feeding belt holder 141 pivots in the counterclockwise direction in the drawing. That is, the pressing member 142 presses the paper feeding belt holder 141 in the direction in which the paper feeding belt 62 is separated from the reverse roller 63.

The biasing member 143 constitutes of, for example, a compression coil spring or the like, and configured to bias the pressing member 142. The biasing member 143 may constitute of, for example, a plate spring or the like insofar as the pressing member 142 can be biased.

The cam member 145 is fixed to a cam driving shaft 145*a*, and is driven to rotate around the cam driving shaft 145*a* by the cam driving motor 128 (see FIG. 3) which can rotate the cam driving shaft 145*a*.

The cam member 145 constitutes of a so-called eccentric cam and configured in such a manner that a cam surface having different contact radii comes into contact with the edge portion of the paper feeding belt holder 141 on the side of the paper feeding belt driven roller 131. When a cam surface having a large contact radius comes into contact with the paper feeding belt holder 141, the cam member 145 pivots the paper feeding belt holder 141 in the clockwise direction against a biasing force exerted by the pressing member 142 and the biasing member 143. That is, the paper feeding belt 62 is moved to the contact position (the position shown in FIG. 7).

Figure 8:
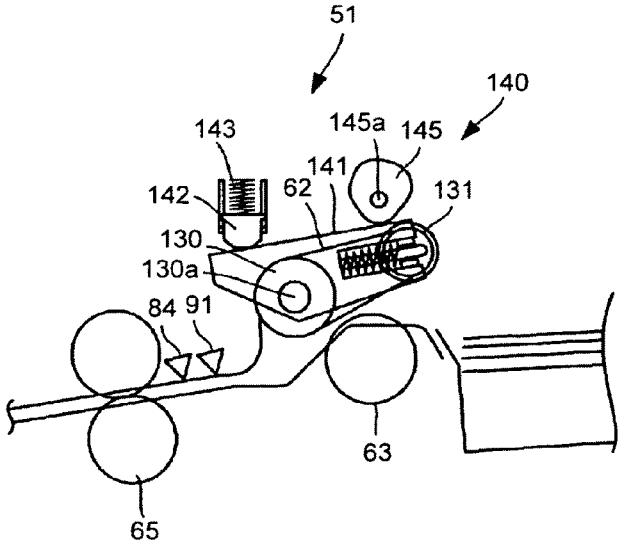
FIG. 8 is a diagram showing a separating and feeding unit in the ADF according to the embodiment of the invention and is a schematic configuration diagram showing a state where a paper feeding belt is at a separate position.

On the other hand, as shown in FIG. 8, when a cam surface having a small contact radius comes into contact with the paper feeding belt holder 141, the cam member 145 pivots the paper feeding belt holder 141 in the counterclockwise direction by the biasing force exerted by the pressing member 142 and the biasing member 143. That is, the paper feeding belt 62 is moved from the contact position (the position shown in FIG. 7) to the separate position (the position shown in FIG. 8).

Next, the separating pressure switching control in the controller 100 and an operation thereof will be described with reference to FIGS. 9 to 17. Hereinafter, description will be provided with reference to a flowchart of FIG. 9 while appropriately using FIGS. 10 to 17.

Figure 9:
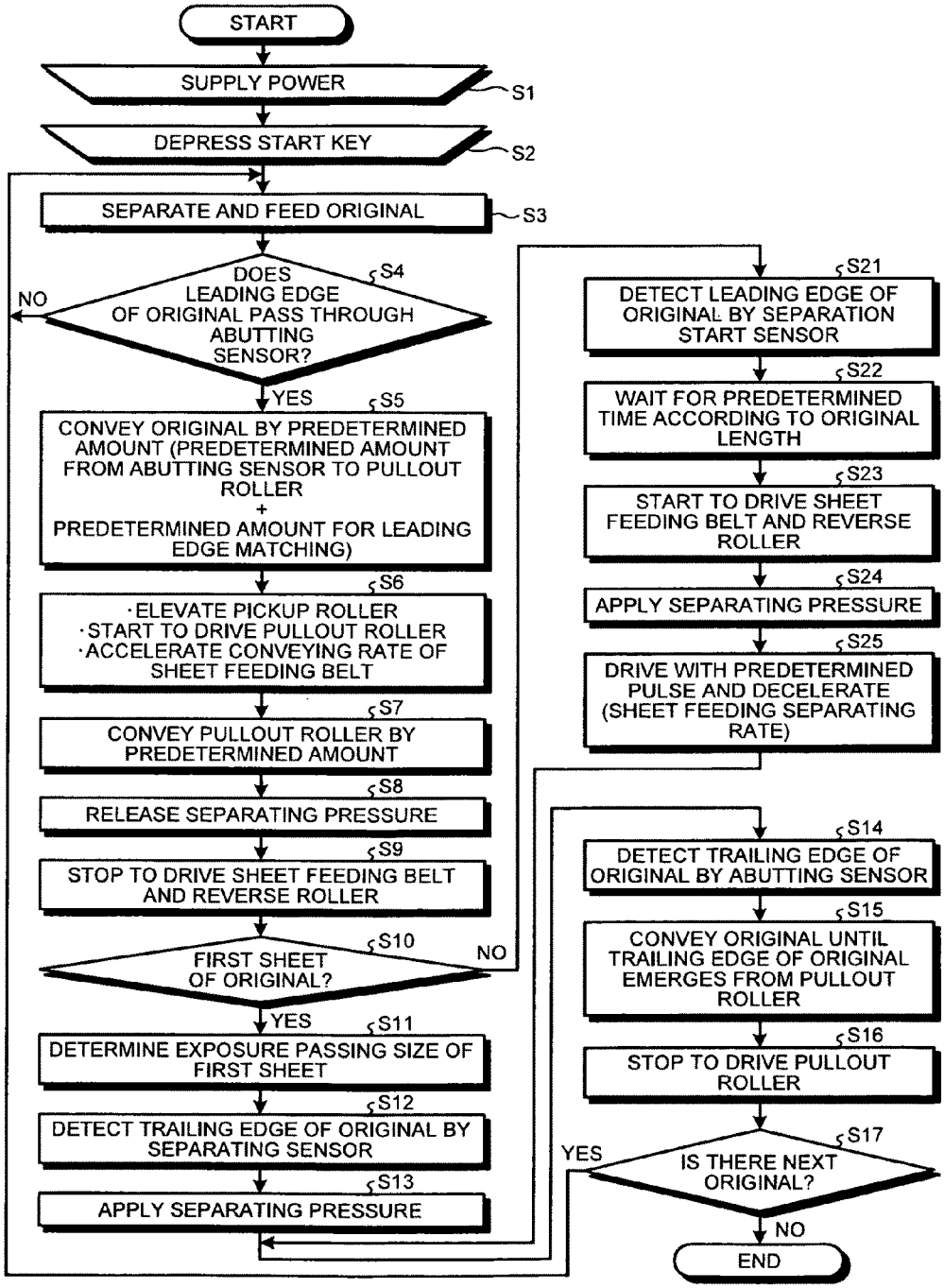
FIG. 9 is a flowchart showing an operation relating to separating pressure switching control which is performed by a controller in the ADF according to the embodiment of the invention.

As shown in FIG. 9, first, if power is supplied (Step S1) and a start key is depressed (Step S2), the controller 100 carries out the separating and feeding operation of an uppermost original $P_1$ placed on the original tray 11 (see FIG. 2) (Step S3). Specifically, in order to carry out the separating and feeding operation of the original $P_1$, the controller 100 drives the respective motors of the pickup lifting motor 120, the pickup conveying motor 121, and the feeding motor 122 (see FIG. 3).

Figure 10:
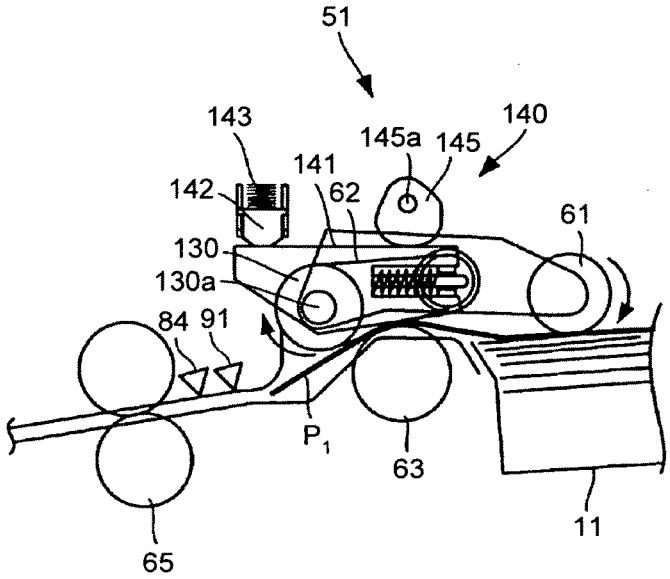
FIG. 10 is a diagram illustrating an operation of the ADF according to the embodiment of the invention and is a diagram showing when an original is separated and fed.

In the separating and feeding operation, as shown in FIG. 10, first, the leading edge of the original $P_1$ is picked up by the pickup roller 61 and guided between the paper feeding belt 62 and the reverse roller 63 (hereinafter, simply referred to as a separating section). At this time, the paper feeding belt 62 is fixed at a position where a predetermining winding angle can be regulated with respect to the reverse roller 63. Thus, when an original other than the original $P_1$ is guided, double feeding is prevented by the operation of the reverse roller 63. That is, the paper feeding belt 62 is at the contact position and separates the original $P_1$ from other originals in cooperation with the reverse roller 63. Only the separated original $P_1$ passes through the separating section and is fed to the downstream side in the conveying direction.

Next, the controller 100 monitors whether or not the leading edge of the original $P_1$ after being separated passes through the abutting sensor 84 (Step S4). This monitoring is carried out on the basis of a signal input from the abutting sensor 84. When the leading edge of the original $P_1$ does not pass through the abutting sensor 84, the controller 100 returns to Step S3 and continues the separating and feeding operation of the original $P_1$.

When the leading edge of the original $P_1$ passes through the abutting sensor 84, the controller 100 conveys the original $P_1$ toward the pullout roller 65 on the downstream side of the original conveying direction by a predetermined amount (Step S5). Specifically, in order to convey the original $P_1$ by a predetermined amount, the controller 100 drives the feeding motor 122 (see FIG. 3) by a predetermined amount. Here, the predetermined amount when the original $P_1$ is conveyed is a value which is obtained by adding a predetermined amount for skew correction to a predetermined amount from the abutting sensor 84 to the pullout roller 65.

The controller 100 drives the pickup lifting motor 120 (see FIG. 3) so as to elevate the pickup roller 61, and also drives the pullout motor 126 (see FIG. 3) so as to drive the pullout roller 65 after a skew correction is carried out (Step S6). The controller 100 controls the driving of the feeding motor 122 so that the paper feeding belt 62 is accelerated to a predetermined original-conveying rate $V_1$. Here, the original-conveying rate $V_1$ is set to be larger than an original-conveying rate $V_2$ of the pullout roller 65 or equal to the original-conveying rate $V_2$. In this embodiment, the original-conveying rate $V_1$ that is set to be equal to the original-conveying rate $V_2$ corresponds to a first original-conveying rate of the invention, and the original-conveying rate $V_1$ that is set to be higher than the original-conveying rate $V_2$ corresponds to a fourth original-conveying rate of the invention. In this embodiment, the original-conveying rate $V_2$ corresponds to a second original-conveying rate of the invention.

Figure 11:
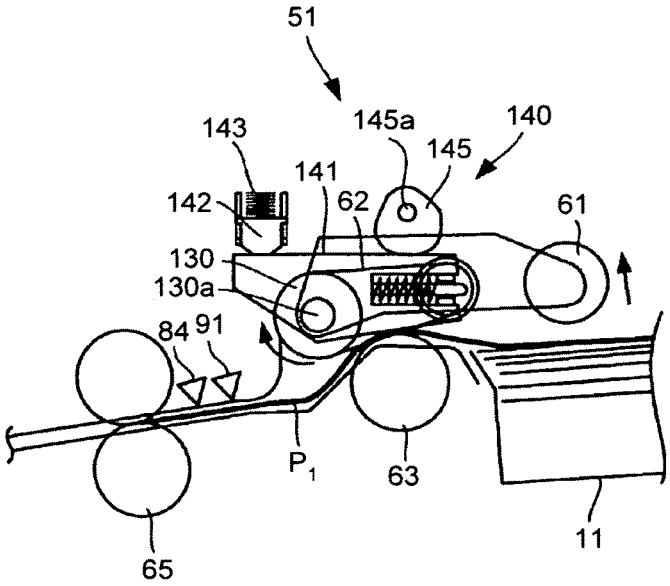
FIG. 11 is a diagram illustrating an operation of the ADF according to the embodiment of the invention and is a diagram showing a state where an original after separated abuts on a pullout roller.

In the processing of each of Steps from S4 to S6, as shown in FIG. 11, the separated original $P_1$ is first conveyed after the leading edge thereof is detected by the abutting sensor 84 and abuts on the pullout roller 65 being stopped. Thereafter, the original $P_1$ is conveyed by a predetermined amount after the leading edge thereof is detected by the abutting sensor 84 and is pressed against the pullout roller 65 in a state where a predetermined amount of bending is formed. At this stage, the pickup roller 61 is elevated and retracted upward from the top surface of the bundle of the originals so that the original $P_1$ is conveyed only by the conveying force of the paper feeding belt 62. Thus, the leading edge of the original $P_1$ enters the nip of a pair of upper and lower rollers of the pullout roller 65, and matching (skew correction) is carried out on the leading edge of the original $P_1$.

Figure 12:
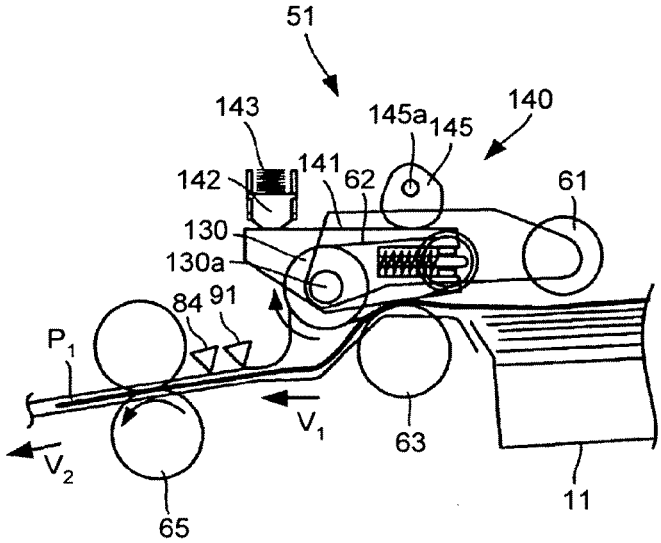
FIG. 12 is a diagram illustrating an operation of the ADF according to the embodiment of the invention and is a diagram showing a form in which an original after a skew correction is conveyed.

Next, as shown in FIG. 12, a predetermined amount of bending is formed in the original $P_1$, skew correction is carried out, and the pullout motor 126 (see FIG. 3) is driven to drive and rotate the pullout roller 65. Thus, the original $P_1$ is conveyed toward the downstream side in the conveying direction by the pullout roller 65. Here, conveyance by the paper feeding belt 62 does not become a load of conveying by the pullout roller 65 since the original-conveying rate $V_1$ of the paper feeding belt 62 is set to be higher than the original-conveying rate $V_2$ of the pullout roller 65 or set to be equal to the original-conveying rate $V_2$.

Next, when the pullout roller 65 conveys the original $P_1$ by a predetermined amount, that is, when the pullout motor 126 is driven with a predetermined pulse (Step S7), the controller 100 releases the separating pressure of the paper feeding belt 62 (Step S8). Specifically, the controller 100 drives the cam driving motor 128 (see FIG. 3) so that the paper feeding belt 62 is separated from the reverse roller 63. The controller 100 stops to drive the paper feeding belt 62 and the reverse roller 63 (Step S9). Specifically, the controller 100 stops to drive the feeding motor 122.

Figure 13:
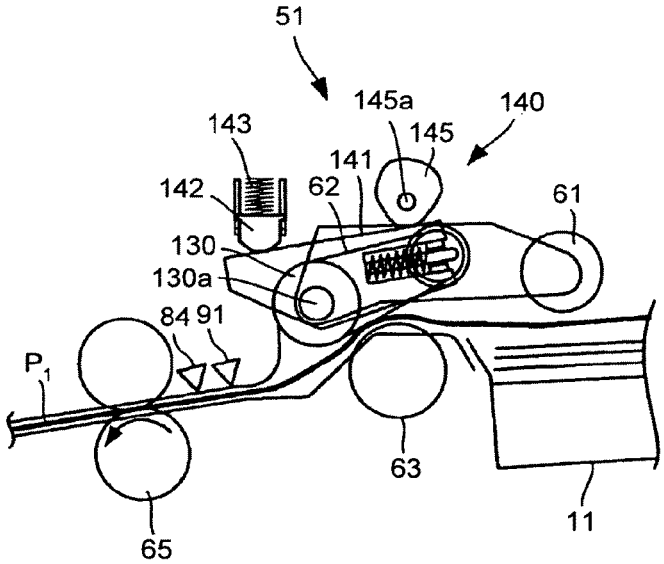
FIG. 13 is a diagram illustrating an operation of the ADF according to the embodiment of the invention and is a diagram showing a state where a separating pressure to an original is released.

That is, as shown in FIG. 13, when the pullout motor 126 is driven with a predetermined pulse, the paper feeding belt 62 which is in contact with the reverse roller 63 at a predetermined separating pressure moves to the separate position, and the driving thereof is stopped. Thus, the original $P_1$ is conveyed by the pullout roller 65 in a state where the separating pressure is released.

The driving shaft 130*a* of the paper feeding belt driving roller 130 is provided with a one-way clutch. Hence, if a rotational driving is applied to the driving shaft 130*a* in the paper feeding direction (the clockwise direction in FIG. 13), the one-way clutch is locked and the rotational driving is transmitted to the belt via the paper feeding belt driving roller 130, whereas if the rotational driving is applied to the driving shaft 130*a* in the opposite direction, the driving shaft 130*a* runs idle. Thus, when the original $P_1$ is pulled in the paper feeding direction, the paper feeding belt driving roller 130 accompanies the original $P_1$ to run idle. Thus, even when the original $P_1$ is pulled by the conveying roller in the downstream side, the separating pressure does not becomes a load if the separating pressure of the paper feeding belt 62 is released.

Next, the controller 100 determines whether or not the original $P_1$ is a first sheet of a bundle of the original (Step S10). This determination is carried out on the basis of, for example, an input signal from the original-setting sensor 82 (see FIG. 3).

Figure 14:
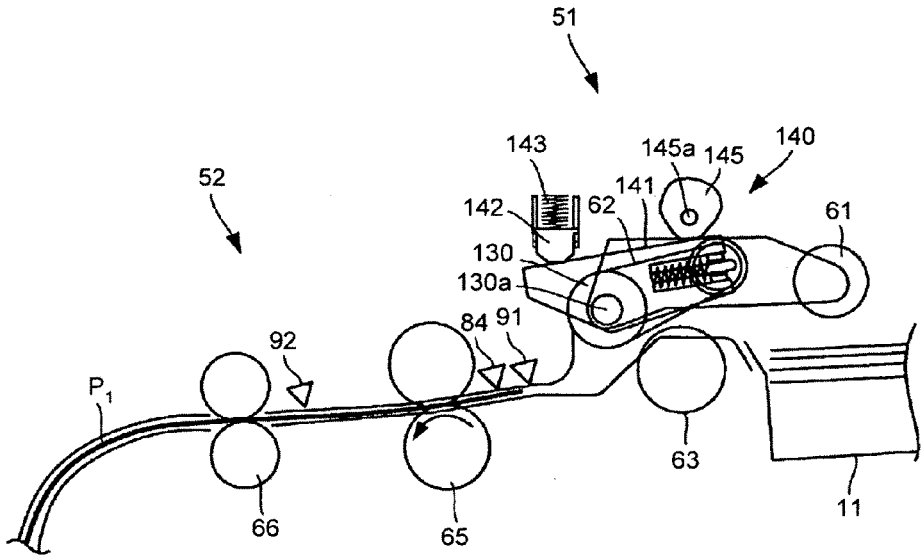
FIG. 14 is a diagram illustrating an operation of the ADF according to the embodiment of the invention and is a diagram showing a state where an original after being separated is further conveyed.

When it is determined that the original $P_1$ is the first sheet of a bundle of the original, the exposure passing size of the first sheet is determined (Step S11), and thereafter, as shown in FIG. 14, the trailing edge of the original $P_1$ is detected by the separation sensor 91 (Step S12). Here, the original length of the original $P_1$ is detected from, for example, the detection result of the registration sensor 81 or a scanned image.

If the trailing edge of the original $P_1$ is detected by the separation sensor 91, the controller 100 applies the separating pressure (Step S13). That is, the controller 100 drives the cam driving motor 128 so as to move the paper feeding belt 62 at the separate position to the contact position.

Figure 15:
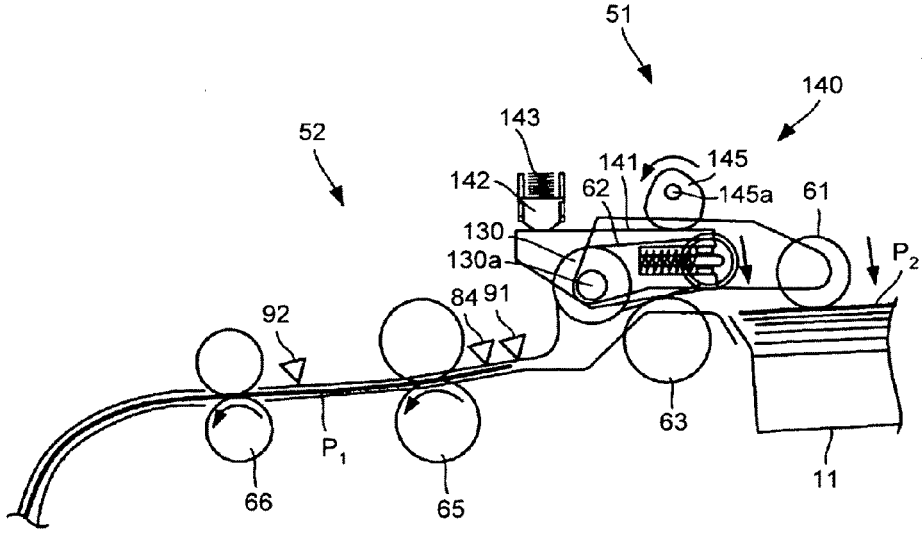
FIG. 15 is a diagram illustrating an operation of the ADF according to the embodiment of the invention and is a diagram showing a state where a separating pressure is applied again.

Thus, as shown in FIG. 15, the paper feeding belt 62 moves to the contact position again to be in contact with the reverse roller 63 at a predetermined separating pressure in preparing for the separation and feeding of the next original $P_2$ that is going to be separated and fed next.

In order to carry out the separating and feeding operation of the next original $P_2$ certainly, before the next original $P_2$ is fed from the bundle of originals to the separating section by the pickup roller 61, the paper feeding belt 62 has to be in a state in which the separating pressure is applied, i.e., the paper feeding belt 62 has to be moved to the contact position. Thus, in this embodiment, it is necessary that the timing at which the trailing edge of the original $P_1$ is detected by the separation sensor 91 is the timing at which the paper feeding belt 62 can be in time to move to the contact position again.

Although in this embodiment, the separating pressure is applied again on the basis of the timing at which the trailing edge of the original $P_1$ is detected by the separation sensor 91, the invention is not limited thereto. For example, the separating pressure may be applied again on the basis of the timing at which the leading edge of the original $P_1$ is detected by the separation starting sensor 92. In this case, compared to a case in which the trailing edge of the original $P_1$ is detected by the separation sensor 91, it is possible to shorten the interval of separating and feeding the sheets of the original and also the interval of conveying the sheets of the original. That is, it takes a certain length of time (a time necessary to pursue a pressure applying operation) for the paper feeding belt 62 to move from the separate position to the contact position. Accordingly, by considering the certain length of time, it is possible to start to move the paper feeding belt 62 to the contact position in a state where the trailing edge of the original $P_1$ has not passed through the separating section yet. That is, while the trailing edge of the preceding original $P_1$ is passing through the separating section, it is possible to carry out the separating pressure applying operation to prepare for separating and feeding the next original $P_2$. Thus, it is possible to set a state in which the separating pressure can be applied more quickly than a case in which the separating pressure is applied at the timing at which the trailing edge of the original $P_1$ is detected by the separation sensor 91. Thus, it is possible to shorten the interval between the sheets of the original in feeding to make it possible to further improve the productivity in canning the original. Furthermore, even when the separating pressure that is applied again is applied to the trailing edge of the original $P_1$, since the original-conveying rate $V_1$ of the paper feeding belt 62 is set to be larger than or equal to the original-conveying rate $V_2$ of the pullout roller 65, the separating pressure does not become a load to convey the original $P_1$ and, as a result, a skew of the original $P_1$ is also suppressed.

Next, after the separating pressure is applied in Step S13, the controller 100 detects the trailing edge of the original $P_1$ by the abutting sensor 84 (Step S14) and conveys the original $P_1$ by a predetermined amount necessary for allowing the trailing edge of the original $P_1$ to pass through the pullout roller 65 (Step S15). That is, the controller 100 drives the pullout motor 126 with a predetermined pulse in accordance with the above-described predetermined amount of conveyance. After the pullout motor 126 is driven with a predetermined pulse, the controller 100 stops to drive the pullout motor 126 (Step S16). Thus, a driven rotation of the pullout roller 65 is stopped.

Thereafter, the controller 100 determines whether or not there is the next original $P_2$ to be separated and fed (Step S17). When it is determined that the next original $P_2$ is absent, the controller 100 ends this processing.

When it is determined that there is the original $P_2$, the controller 100 returns to Step S3 and performs the processing in Step S3 and subsequent steps again on the next original $P_2$.

Next, on the basis of Steps from S21 to S25 shown in FIG. 9, it will be described of the processing and the operations when an original to be separated and fed is a second sheet or subsequent sheet of the original (for example, the next original $P_2$).

As for the original that is set on the original tray 11, a length of the original is detected by the original-length detection sensors 89 and 90 (see FIG. 1). Thus, while it is possible to detect the size of a provisionally set original, when a bundle of original that is set on the original tray 11 has the same size, it becomes possible to identify a length of the original more accurately by detecting the length of the first original $P_1$ in Step S11. Thus, for a third or subsequent original $P_3$, by carrying out the subsequent steps with the detection of the leading edge of the next original $P_2$ by the separation starting sensor 92 arranged at an appropriate position as a trigger, the interval between the next original $P_2$ and a subsequent original (for example, the interval between the next original $P_2$ and the next original $P_3$) is made shorter than the interval between the first sheet and the second sheet of the original, i.e., between the original $P_1$ and the next original $P_2$.

Specifically, in Step S10, when the controller 100 determines that the original $P_1$ is not the first sheet of the original but the next original $P_2$, the leading edge of the next original $P_2$ is detected by the separation starting sensor 92 (Step S21).

Figure 16:
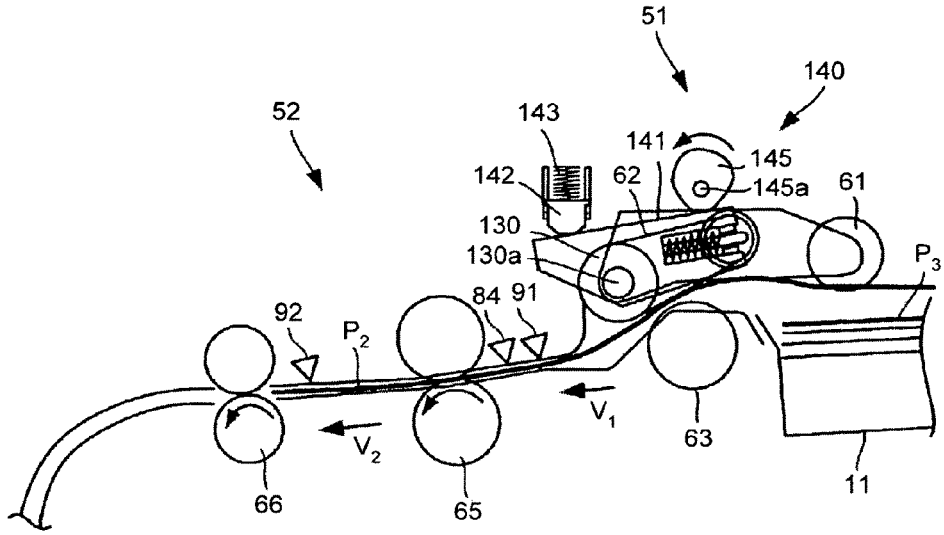
FIG. 16 is a diagram illustrating an operation of the ADF according to the embodiment of the invention and is a diagram showing a form in which a second sheet of the original is conveyed.

If the leading edge of the next original $P_2$ is detected by the separation starting sensor 92, the controller 100 waits for a predetermined time corresponding to the original length with the detection of the leading edge of the next original $P_2$ as a trigger (Step S22). That is, as shown in FIG. 16, if the leading edge of the next original $P_2$ is detected by the separation starting sensor 92, thereafter, the controller 100 keeps to stop driving the feeding motor 122 until the predetermined time corresponding to the original length elapses.

After waiting for the predetermined time corresponding to the original length, the controller 100 starts to drive the feeding motor 122 so as to start the driving of the paper feeding belt 62 and the reverse roller 63 (Step S23). At this stage, the original-conveying rate $V_1$ of the paper feeding belt 62 is set to be larger than the original-conveying rate $V_2$ of the pullout roller 65 or equal to the original-conveying rate $V_2$. As described above, in this embodiment, the controller 100 drives the feeding motor 122 at the timing faster than the timing of starting to apply the separating pressure to be described below.

Next, the controller 100 applies the separating pressure (Step S24). That is, the controller 100 drives the cam driving motor 128 so as to move the paper feeding belt 62 in the separate position to the contact position. As described above, if the predetermined time corresponding to the original length is provided, the paper feeding belt 62 starts to move to the contact position at the timing such that the interval between the next original $P_2$ and the next original $P_3$ becomes minimum, and the separating pressure is applied and separation is prepared by the time when the next original $P_3$ is fed into the separating section.

Figure 17:
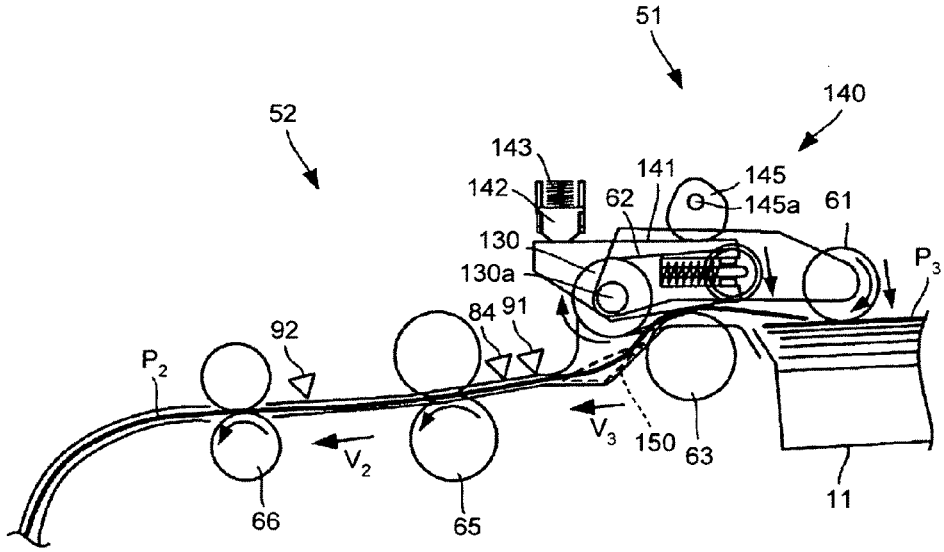
FIG. 17 is a diagram illustrating an operation of the ADF according to the embodiment of the invention and is a diagram showing a state where a separating pressure is applied again in conveying a second sheet of an original.

Next, the controller 100 controls the driving of the feeding motor 122 in such a manner that the paper feeding belt 62 is decelerated to the original-conveying rate $V_3$ after the feeding motor 122 is driven with a predetermined pulse (Step S25), and thereafter, passes to Step S14. That is, as shown in FIG. 17, after the paper feeding belt 62 conveys the original $P_2$ by a predetermined amount at the original-conveying rate $V_1$, the original-conveying rate $V_1$ of the paper feeding belt 62 is decelerated to the original-conveying rate $V_3$ suitable for the separating and feeding operation of the next third original $P_3$. The original-conveying rate $V_3$ is set to be smaller than the original-conveying rate $V_2$ of the pullout roller 65. In this embodiment, the original-conveying rate $V_3$ corresponds to a third original-conveying rate of the invention.

The conveying amount of the next original $P_2$ which is conveyed by the paper feeding belt 62 at the original-conveying rate $V_1$ is set in such a manner that the amount of bending of the next original $P_2$ which is formed by a difference between the original-conveying rate $V_1$ and the original-conveying rate $V_2$ is equal to or smaller than the amount of bending that is admittable in an original bending space 150.

Since the original-conveying rate $V_3$ of the decelerated paper feeding belt 62 is smaller than the original-conveying rate $V_2$ of the pullout roller 65, even if the paper feeding belt 62 is circulating, an interval is formed between the next original $P_2$ and the next original $P_3$. After the trailing edge of the next original $P_2$ is detected by the abutting sensor 84 (Step S14), when the next original $P_2$ is conveyed by a predetermined amount, or more precisely, when the trailing edge of the next original $P_2$ passes through the pullout roller 65 (Step S15), the driven rotation of the pullout roller 65 is stopped (Step S16). Thus, the next third original $P_3$ abuts on the pullout roller 65 that is stopped, and double feeding does not occur.

As described above, the timing at which the next second original $P_2$ is conveyed to the separating section with the separating pressure being applied is different from the timing at which the next third original $P_3$ is fed into the separating section. That is, as the timing at which the next second original $P_2$ is fed into the separating section, it is necessary that the original size of the first original $P_1$, particularly, the original length is determined, and it is also necessary that the trailing edge of the original $P_1$ has passed through the separating section. In determining the original size, it is necessarily that the trailing edge of the original $P_1$ has passed through the separating section. Thus, the timing at which the next original $P_2$ is fed into the separating section becomes relatively slower than the timing at which the third or subsequent sheet of the original (for example, the next original $P_3$) is fed into the separating section. Therefore, the timing at which the paper feeding belt 62 returns from the separate position to the contact position becomes slower for the second original $P_2$ than for the third or subsequent sheet of the original (for example, the next original $P_3$).

As described above, in this embodiment, since the controller 100 controls the separating pressure switching mechanism 140 to release the separating pressure after the leading edge of the preceding original has passed through the separating section, the separating pressure in the separating section, which may become the conveying resistance to the preceding original after being separated, is released. Thus, when the preceding original after being separated is conveyed by the pullout roller 65, it is possible to prevent the conveying force from going out of balance due to the separating pressure.

The controller 100 controls the separating pressure switching mechanism 140 to apply the separating pressure before the next original is fed from the bundle of originals to the separating section. Thus, it is possible to shorten the interval between the preceding original and the next original.

Therefore, in this embodiment, it is possible to prevent the occurrence of a skew to the original and to improve the productivity in scanning the original.

In this embodiment, the controller 100 controls the separating pressure switching mechanism 140 to release the separating pressure when the original is conveyed by a predetermined amount after the leading edge of the original has been detected by the abutting sensor 84. Thus, it is possible to release the separating pressure at the timing when the original after being separated is conveyed by the pullout roller 65.

In this embodiment, the controller 100 controls the separating pressure switching mechanism 140 to apply the released separating pressure again when the trailing edge of the original is detected by the separation sensor 91. Thus, it is possible to apply the separating pressure after the trailing edge of the preceding original has certainly passed through the separating section, and to prepare for separating and feeding the next original.

In this embodiment, the controller 100 controls the separating pressure switching mechanism 140 to apply the released separating pressure again at a predetermined timing corresponding to the length of the first original $P_1$ after the leading edge of the second or subsequent original (for example, the next original $P_2$) has been detected by the separation starting sensor 92. Thus, it is possible to shorten the timing for separating and feeding the third or subsequent original (for example, the next original $P_3$) compared to the timing for separating and feeding the second original $P_2$ in accordance with the known length of the first original $P_1$, and hence, it is possible to further improve the productivity in scanning the original.

In this embodiment, the controller 100 controls such that the feeding motor 122 is driven at a timing that is faster than the timing of starting the application of the separating pressure by the separating pressure switching mechanism 140. Therefore, the state of applying the separating pressure is reached while the paper feeding belt 62 and the reverse roller 63 are being driven, and the original-conveying rate of the paper feeding belt 62 can be accelerated to the optimum original-conveying rate $V_1$ that is set in advance until the separating pressure application state is reached. That is, it is possible to secure the time necessary for accelerating the original-conveying rate of the paper feeding belt 62 to the optimum original-conveying rate $V_1$ before the state of applying the separating pressure is reached. Therefore, it is possible to improve the productivity in scanning the original.

In this embodiment, the original-conveying rate of the paper feeding belt 62 when the application of the separating pressure is started is set to be equal to the original-conveying rate $V_2$ of the pullout roller 65 or set to the original-conveying rate $V_1$ that is larger than the original-conveying rate $V_2$. Thus, even when the separating pressure which is applied again for the next original is applied to the trailing edge of the preceding original, it is possible to prevent the separating pressure from becoming the conveying resistance to the preceding original.

In this embodiment, the controller 100 controls the feeding motor 122 in such a manner that the original-conveying rate $V_1$ is decelerated to the original-conveying rate $V_3$ that is smaller than the original-conveying rate $V_2$ at a predetermined timing after the leading edge of the separated original is detected by the separation starting sensor 92. Thus, it is possible to set the conveying interval between the preceding original and the next original to an optimum conveying interval, and to prevent double feeding of the original from occurring. With deceleration to the original-conveying rate $V_3$, it is possible to set the original-conveying rate appropriate for separating and feeding.

Although in this embodiment, the original is separated by the paper feeding belt 62 and the reverse roller 63 in the separating and feeding unit 51, the invention is not limited thereto. For example, instead of the paper feeding belt 62, a paper feeding roller may be used, or the original may be separated by a paper feeding roller and a separating pad. In this case, a configuration is made in such a manner that the paper feeding roller is pivotable between a contact position and a separate position with respect to the reverse roller 63 or the separating pad.

Although in this embodiment, in FIG. 16, the original-conveying rate $V_1$ of the paper feeding belt 62 is decelerated to the original-conveying rate $V_3$ at a predetermined timing (Step S25) after the leading edge of the next original $P_2$ has been detected by the separation starting sensor 92, the invention is not limited thereto. For example, the original-conveying rate $V_1$ of the paper feeding belt 62 may be decelerated to the original-conveying rate $V_3$ at a predetermined timing after the trailing edge of the next original $P_2$ has been detected by the separation sensor 91.

In this case, similarly to this embodiment, it is possible to set the conveying interval between the preceding original and the next original to the optimum conveying interval to make it possible to prevent double feeding of the original. With deceleration to the original-conveying rate $V_3$, it is possible to set the original-conveying rate appropriate for separating and feeding.

Although in this embodiment, the paper feeding belt 62 and the pullout roller 65 are respectively driven by the feeding motor 122 and the pullout motor 126 which are separate driving sources and independent of each other, the invention is not limited thereto. For example, a configuration may be made in such a manner that the paper feeding belt 62 and the pullout roller 65 use the feeding motor 122 as a common driving source.

Figure 18:
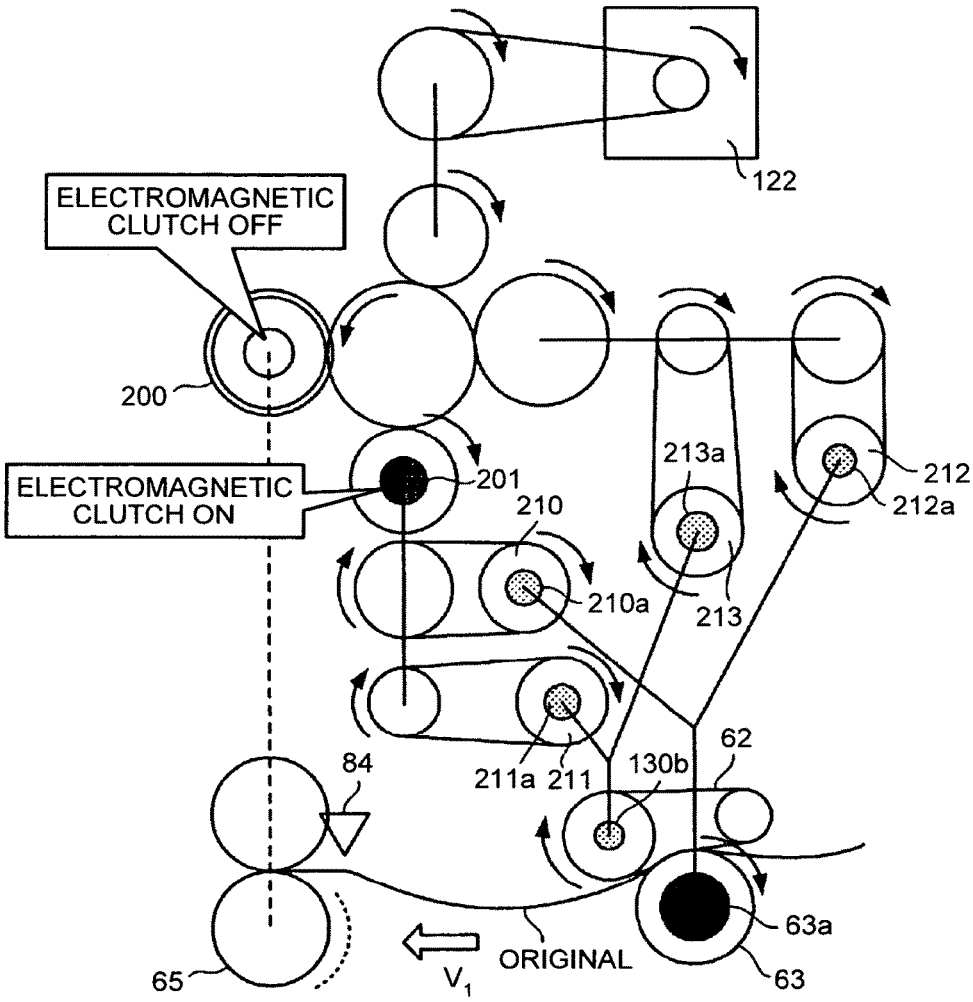
FIG. 18 is a diagram illustrating a switching mechanism in an original-conveying rate of a paper feeding belt according to the embodiment of the invention and is a diagram showing the original-conveying rate of the paper feeding belt when an original abuts on a pullout roller.
Figure 19:
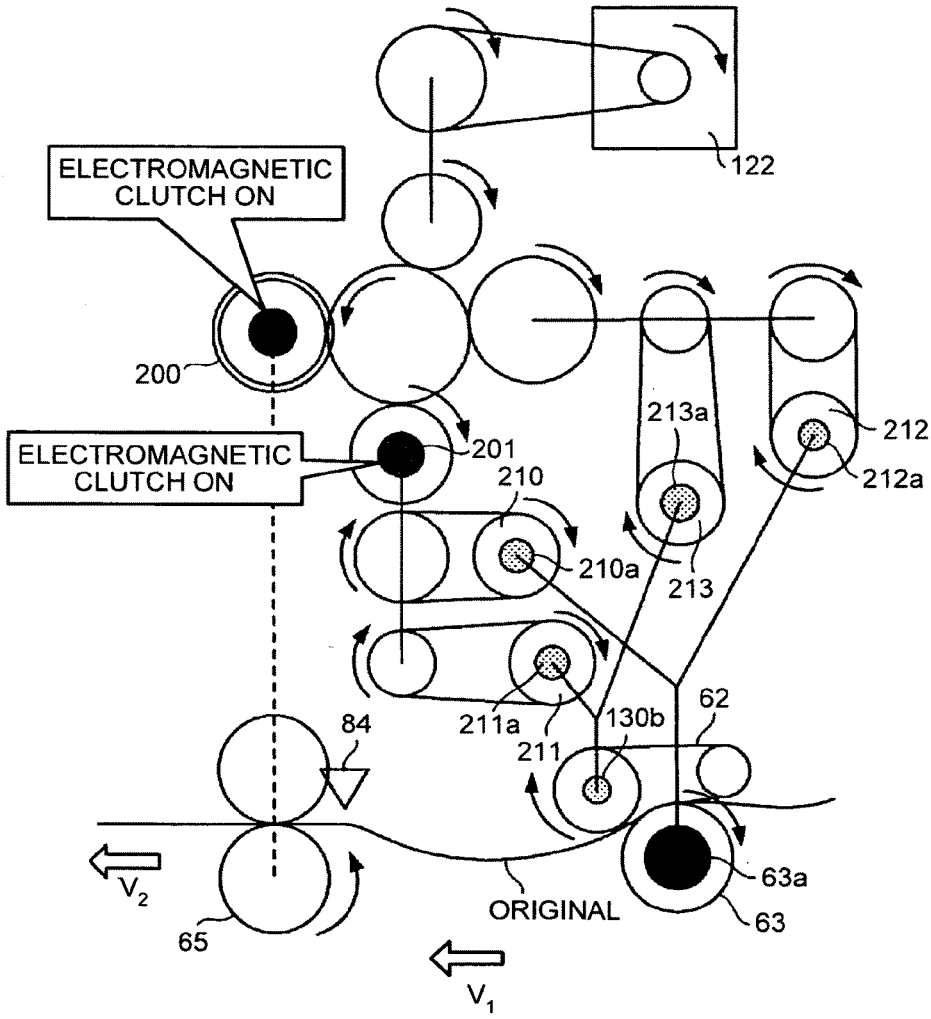
FIG. 19 is a diagram illustrating the switching mechanism in the original-conveying rate of a paper feeding belt according to the embodiment of the invention and is a diagram showing a relationship between the original-conveying rate of the paper feeding belt and the original-conveying rate of the pullout roller.
Figure 20:
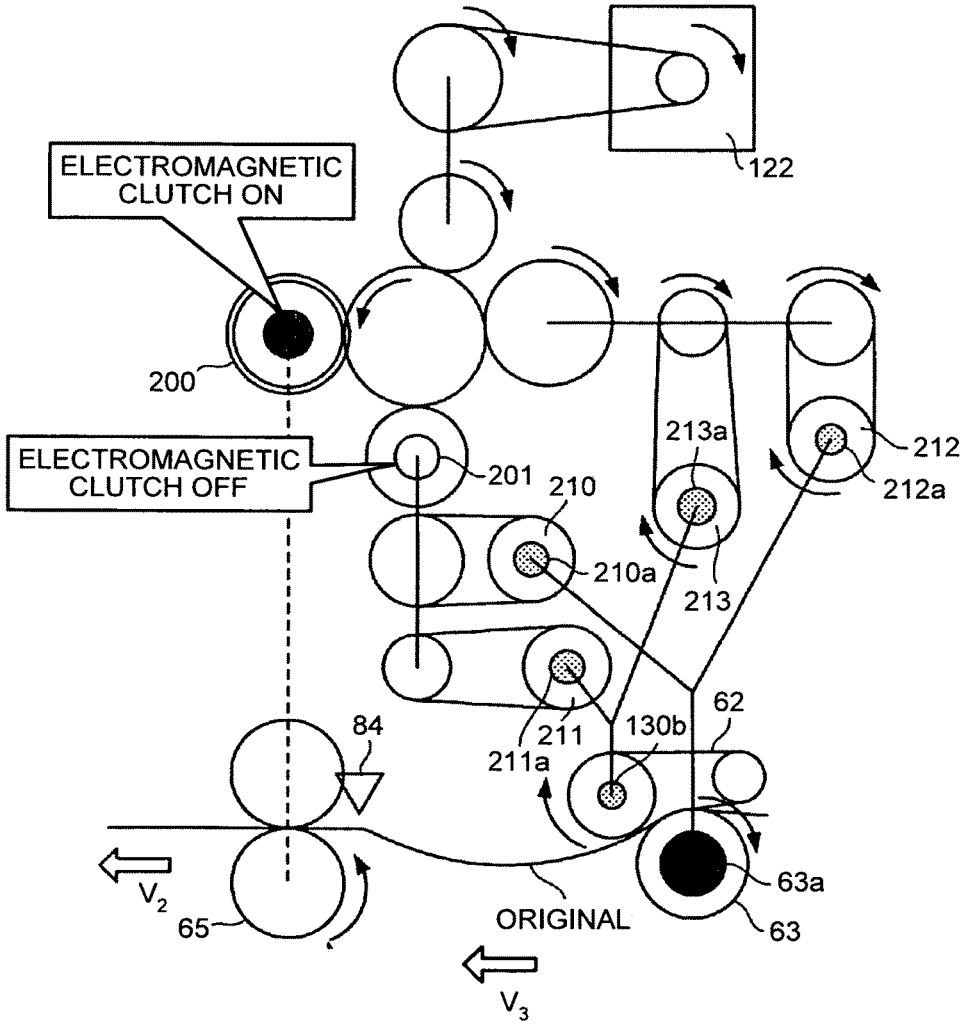
FIG. 20 is a diagram illustrating the switching mechanism in the original-conveying rate of a paper feeding belt according to the embodiment of the invention and is a diagram showing an original-conveying rate when the paper feeding belt is decelerated.

In this case, as shown in FIGS. 18 to 20, electromagnetic clutches 200 and 201 are used to make it possible to switch the original-conveying rate $V_1$ of the paper feeding belt 62.

Specifically, as shown in FIG. 18, when the original abuts on the pullout roller 65, the electromagnetic clutch 200 is OFF, so that the pullout roller 65 is not driven to rotate and stops. On the contrary, since the electromagnetic clutch 201 is ON, the driving of the feeding motor 122 is transmitted to a timing pulley 210 and a timing pulley 211. At this stage, the rotation speed is set such that two inequalities (the timing pulley 210> a timing pulley 212) and (the timing pulley 211> a timing pulley 213) hold by choosing reduction gear ratios. Here, the driving of the paper feeding belt 62 and the reverse roller 63 depends on the timing pulley having a large rotation speed by a one-way clutch 130*b* and one-way clutches 210*a* to 213*a*. Thus, the paper feeding belt 62 is driven at the rotation speed of the timing pulley 210, so that the original abuts on the pullout roller 65 at the original-conveying rate $V_1$. The reverse roller 63 is driven to rotate in the direction indicated by an arrow in the drawing by the action of a torque limiter 63*a*, that is, in the direction opposite to the rotational direction of the paper feeding belt 62.

As shown in FIG. 19, after the original has abutted, when the original is conveyed by the pullout roller 65, the electromagnetic clutch 200 is ON, so that the pullout roller 65 is driven to rotate. Since the electromagnetic clutch 201 is ON, the driving of the feeding motor 122 is transmitted to the timing pulley 210 and the timing pulley 211. The rotation speeds of the respective timing pulleys are the same as the condition that is described above with reference to FIG. 18. Thus, the paper feeding belt 62 and the reverse roller 63 are respectively driven to rotate at the rotation speeds of the timing pulley 210 and the timing pulley 211. The rotational direction of the reverse roller 63 is the same as shown in FIG. 18. Since the relationship $V_1>V_2$ holds for the original-conveying rates, no conveying load of the pullout roller 65 occurs.

As shown in FIG. 20, after the released separating pressure is applied again, during the deceleration of the paper feeding belt 62, the pullout roller 65 is driven to rotate by turning ON the electromagnetic clutch 200. In contrast, since the electromagnetic clutch 201 is OFF, the timing pulley 210 and the timing pulley 211 are not driven, and, accordingly, the paper feeding belt 62 and the reverse roller 63 are respectively driven to rotate at the rotation speeds of the timing pulley 212 and the timing pulley 213. That is, the original-conveying rate of the paper feeding belt 62 is decelerated to the original-conveying rate $V_3$ that is smaller than the original-conveying rate $V_1$. The original-conveying rate $V_3$ is smaller than the original-conveying rate $V_2$ of the pullout roller 65. The rotational direction of the reverse roller 63 is the same as shown in FIG. 18. As described above, in the case shown in FIG. 20, since the relationship $V_2>V_3$ holds for the original-conveying rates, a predetermined interval can be generated from the preceding original and the next original. With predetermined pulse counts after the detection of the trailing edge of the preceding original by the abutting sensor 84, when the trailing edge of the preceding sheet of original passes through the pullout roller 65, the electromagnetic clutch 200 is turned OFF, and the rotation of the pullout roller 65 is stopped. Therefore, even when the next sheet of original is separated and fed, the next sheet of original abuts on the pullout roller 65 to be stopped, and accordingly, double feeding is prevented.

According to the present invention, it is possible to provide an image forming apparatus which includes an automatic document feeder capable of preventing the occurrence of skew with respect to the original and improving productivity of scanning originals.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic document feeder comprising:

a separating and feeding unit which has a separating member and a paper feeding member configured to contact the separating member at a predetermined separating pressure, the separating member and feeding member cooperating to separate and feed originals one-by-one from a bundle of originals placed on an original placing table;

a conveyor configured to convey the originals separated by the separating and feeding unit toward a scanning position;

a separating pressure switch configured to allow the separating pressure to be applied and released;

a first detector between the separating and feeding unit and conveyor, the first detector configured to detect the originals conveyed from the separating and feeding unit to the conveyor; and a controller configured to control the separating pressure switch to release the separating pressure after a leading edge of a first original has passed through the separating and feeding unit and to apply the separating pressure before a second original is fed from the bundle of originals to the separating and feeding unit;

a second detector, which is provided between the separating and feeding unit and the conveyor, wherein, when a trailing edge of the first original is detected by the second detector, the controller controls the separating pressure switch to allow the paper feeding member to apply pressure to the separating member;

a third detector, provided on a downstream side in an original conveying direction of the conveyor, to detect one or more of the originals including the second original conveyed by the conveyor, wherein:

the first original precedes the second original, after a leading edge of the first original is detected by the first detector, the controller controls the separating pressure switch to allow the first original to be conveyed by an additional distance farther than a distance between the first detector and the conveyor, and after a leading edge of the second original is detected by the third detector, the controller controls the separating pressure switch to allow the paper feeding member to apply pressure to the separating member.

2. The automatic document feeder according to claim 1, wherein the separating pressure switch allows the paper feeding member to contact the separating member to apply the separating pressure and allows the paper feeding member to be separated from the separating member to release the separating pressure.

3. The automatic document feeder according to claim 1, wherein, when the first original is conveyed by the additional distance after the leading edge of the first original has been detected by the first detector, the controller controls the separating pressure switch to release the separating pressure.

4. The automatic document feeder according to claim 1, wherein, after the leading edge of the second or a subsequent original is detected by the third detector, the controller controls the separating pressure switch to allow the separating pressure to be applied at a predetermined timing corresponding to a length of the first original.

5. The automatic document feeder according to claim 1, further comprising: a driver to drive the separating and feeding unit, wherein the controller controls the driver at a timing faster than a timing of starting application of the separating pressure.

6. The automatic document feeder according to claim 1, wherein an original-conveying rate of the separating and feeding unit, when starting application of the separating pressure, is set to a first original-conveying rate substantially equal to a second original-conveying rate of the conveyor, and wherein, after a trailing edge of the first original separated by the separating and feeding unit is detected by the second detector, the controller controls a driver to drive the separating and feeding unit in such a manner that the first original-conveying rate is decelerated to a third original-conveying rate, which is lower than the second original-conveying rate at a set timing.

7. The automatic document feeder according to claim 1, wherein an original-conveying rate of the separating and feeding unit, when starting application of the separating pressure, is set to a first original-conveying rate equal to a second original-conveying rate of the conveyor, and wherein, after the leading edge of the first original separated by the separating and feeding unit is detected by the third detector, the controller controls a driver to drive the separating and feeding unit in such a manner that the first original-conveying rate is decelerated to a third original-conveying rate that is smaller than the original-conveying rate at a set timing.

8. The automatic document feeder according to claim 1, wherein a first original-conveying rate of the separating and feeding unit, when starting application of the separating pressure, is set to a rate larger than a second original-conveying rate of the conveyor, and wherein:

after the trailing edge of the first original is detected by the second detector, the controller controls a driver of the separating and feeding unit in such a manner that the first original-conveying rate is decelerated to a third original-conveying rate lower than the second original-conveying rate at a set timing.

9. The automatic document feeder according to claim 1, wherein an original-conveying rate of the separating and feeding unit, when starting application of the separating pressure, is set to a rate larger than an original-conveying rate of the conveyor.

10. An image forming apparatus comprising:

the automatic document feeder according to claim 1.

11. The automatic document feeder according to claim 1, wherein:

the separating member has at least one roller or belt, and the paper feeding member has at least one roller or belt.

* * * * *